US010583678B1

(12) United States Patent
Pirmoradi et al.

(10) Patent No.: US 10,583,678 B1
(45) **Date of Patent: *Mar. 10, 2020**

(54) SINGLE STEP PROCESSING OF COLOR THERMOCHROMIC MATERIALS

(71) Applicant: Palo Alto Research Center Incorporated, Palo Alto, CA (US)

(72) Inventors: Fatemeh Nazly Pirmoradi, Menlo Park, CA (US); Christopher L. Chua, San Jose, CA (US); Yu Wang, Union City, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/211,749

(22) Filed: Dec. 6, 2018

(51) Int. Cl.

| | |
|---|---|
| ***B41J 2/32*** | (2006.01) |
| ***B41M 5/28*** | (2006.01) |
| ***B41M 7/00*** | (2006.01) |
| ***B41M 5/34*** | (2006.01) |

(52) U.S. Cl.
CPC ..... *B41M 5/282* (2013.01); *B41J 2/32* (2013.01); *B41M 5/34* (2013.01); *B41M 7/0081* (2013.01)

(58) Field of Classification Search
CPC ..... B41J 2/32; B41M 5/34; B41M 7/0081; B41M 5/282
See application file for complete search history.

(56) References Cited

U.S. PATENT DOCUMENTS

| | | | |
|---|---|---|---|
| 8,842,145 | B2 | 9/2014 | Cridland et al. |
| 9,475,307 | B2 | 10/2016 | Cridland |
| 2008/0318154 | A1 | 12/2008 | Wyres |

*Primary Examiner* — Lamson D Nguyen
(74) *Attorney, Agent, or Firm* — Mueting, Raasch & Gebhardt, P.A.

(57) ABSTRACT

An approach for forming a multi-colored image on a substrate that includes a thermochromic material capable of producing at least two different colors is disclosed. Individually selected pixels of the thermochromic material that correspond to the image are heated to predetermined temperatures. Each predetermined temperature corresponds to a predetermined color shift of the thermochromic material. While the individually selected pixels are being heated, an area that includes the individually selected pixels is flooded with an amount of UV radiation sufficient to at least partially polymerize the thermochromic material. A color of each individually selected pixel is determined by a predetermined temperature to which the pixel is heated and the amount of UV radiation to which the pixel is exposed.

20 Claims, 13 Drawing Sheets

SINGLE STEP PROCESSING OF COLOR THERMOCHROMIC MATERIALS

BACKGROUND

Thermochromic materials change color in response to exposure to temperature and light. Thermochromic inks can be applied to relatively larger areas on a substrate by a number of printing or coating processes such as lithography, flexography, gravure, screen printing, spreading with film applicators. After coating or printing the larger areas with the thermochromic material, the areas are exposed to heat and light to produce a color change in precisely controlled regions.

BRIEF SUMMARY

Some embodiments involve a method of forming a multi-colored image on a substrate that includes a thermochromic material capable of producing at least two different colors. Individually selected pixels of the thermochromic material that correspond to the image are heated to predetermined temperatures. Each predetermined temperature corresponds to a predetermined color shift of the thermochromic material. While the individually selected pixels are being heated, an area that includes the individually selected pixels is flooded with an amount of UV radiation sufficient to at least partially polymerize the thermochromic material. A color of each individually selected pixel is determined by a predetermined temperature to which the pixel is heated and the amount of UV radiation to which the pixel is exposed.

Some embodiments are directed to an apparatus for forming a multi-colored image on a substrate that includes a thermochromic material capable of producing at least two different colors. The apparatus includes a heat source configured to heat one or more individually selected pixels of the image to one or more predetermined temperatures. Each predetermined temperature corresponds to a predetermined color shift of the thermochromic material. The apparatus also includes a UV radiation source configured to flood an area that includes the individually selected pixels of the thermochromic material with UV radiation sufficient to at least partially polymerize the thermochromic material during the same time that the heat source heats the one or more individually selected pixels of the thermochromic material.

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Processing color thermochromic material typically involves a three-step process, including two registered laser exposures. The coating comprising the thermochromic material needs to first be activated with an initial heat exposure, then developed (polymerized) with exposure to deep UV light, and subsequently heated a second time to achieve and define the desired color. The first and second heating steps are typically implemented using lasers, though other implementations such as conductive heating with resistive heaters or heating with patterned hot air streams are possible. The two separate heating steps require pixel-to-pixel registration which increases system complexity. Furthermore, the legacy system requires two light imaging modules for heating the thermochromic material—one for activation and one for color definition—that is about twice as costly as a system requiring only one imaging module.

The approaches disclosed herein involve a system and method for image formation using thermochromic material in a single color processing step. The embodiments described involve simultaneous UV and heat exposures, where separate activation, polymerization, and color shift steps are compressed into a single step. The ability to realize a final stable color within a single exposure step significantly reduces system complexity by eliminating the need for registration of two heat sources and reduces system component costs by eliminating one of the heat sources.

Image formation as discussed herein involves the use of a thermochromic material that changes color when exposed to heat. Embodiments herein provide approaches for forming a multi-colored image on a substrate that includes a thermochromic material capable of producing at least two different colors. The approaches described involve heating individually selected pixels of the thermochromic material that correspond to the image to predetermined temperatures. Each predetermined temperature corresponds to a predetermined color shift of the thermochromic material. While the individually selected pixels are being heated, an area that includes the individually selected pixels is flooded with an amount of UV radiation sufficient to at least partially polymerize the thermochromic material. The color of each individually selected pixel after processing by heating and flooding with UV radiation is determined by the temperature to which the pixel is heated and the amount of UV radiation to which the pixel is exposed.

Figure 1A:
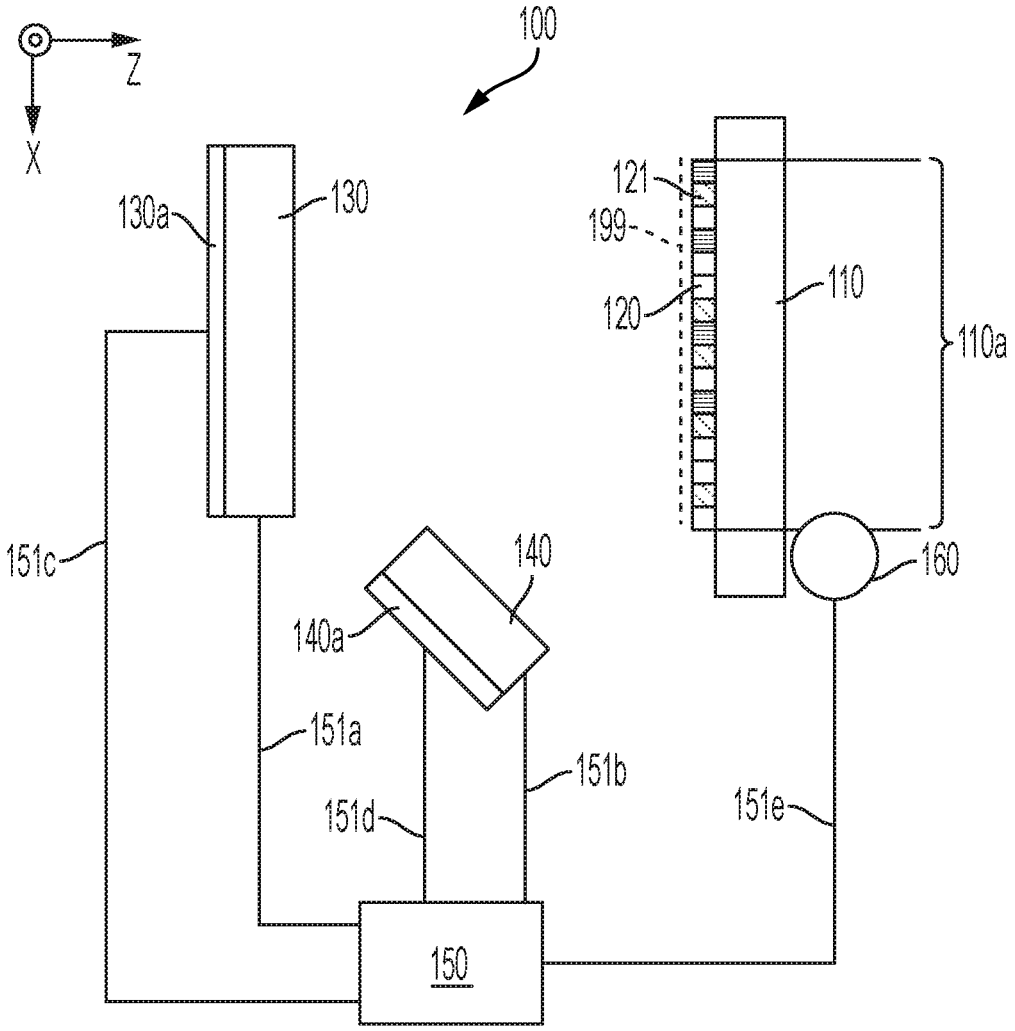
FIG. 1A illustrates a block diagram of a system for forming an image on a substrate in accordance with some embodiments.

FIG. 1A illustrates a block diagram of a system 100 for forming an image in pixels 121 of a thermochromic material disposed on a substrate 110 in accordance with embodiments described herein. As illustrated in FIG. 1A, a layer 120 comprising a thermochromic material is applied to a region 110*a* of the substrate 110 in which the image will be formed. The thermochromic layer 120 may be substantially continuous or discontinuous and may be patterned into segments of the thermochromic material. Pixels 121 of the thermochromic layer 120 are individually addressable by a heat source 130. The controller 150 maps an image to individually selected pixels 121 and the individually selected pixels of the thermochromic layer 120 are heated by the heat source 130 to one or more predetermined temperatures. Each temperature is associated with a color shift in the thermochromic material. During the time that the individually selected pixels 121 are being heated, an area of the thermochromic layer that includes the individually selected pixels is flooded with ultraviolet (UV) radiation from a UV radiation source 140. The amount of UV radiation to which the individually selected pixels are exposed is sufficient to at least partially polymerize the thermochromic material 120. The duration of time that the area is exposed to the UV radiation may be the same as, longer than, or shorter than the duration of time that the pixels are heated. The area flooded with UV radiation may be the same as the area of the individually selected pixels or the flooded area may be slightly larger than the area of the individually selected pixels.

Heating the pixels causes the pixels to change color, wherein the final color of each individually selected pixel is determined by one or both of the temperature to which the pixel is heated and the amount of the UV radiation that the pixel is exposed to. The heat source 130 may have a resolution such that 300 pixels per inch (ppi) or 600 ppi, or even 1200 ppi at the image plane are individually addressable. The chosen designed resolution depends on tradeoffs between cost and application needs. The UV radiation source 140 is a UV radiation flood source capable of flooding an area of the thermochromic layer 120 at least large enough that all of the individually selected pixels are flooded with UV radiation while they are simultaneously being heated. For example, the flooded area may be 5×, 10×, 50×, or even 100× the pixel size.

The layer 120 that includes thermochromic material may be deposited by any suitable printing process, e.g., ink jet printing, screen printing, flexographic printing, etc. The thermochromic material can be or can include diacetylene and/or or another thermochromic material capable of producing at least two colors, e.g., red and blue, when heated. In some embodiments, other additives that control and/or assist in heat absorption and/or heat retention may also be included in the layer 120. For example, in embodiments wherein the thermochromic material is heated by radiation, infrared (IR) and/or near infrared (NIR) radiation absorbers may be included in the layer to adjust the response of the thermochromic material to the radiation. Prior to processing by heating and UV radiation exposure, the thermochromic material 120 may be colorless. For example, prior to processing, the thermochromic material 120 can be substantially clear such that the substrate 110 is visible through the thermochromic material 120.

In some embodiments, control circuitry maps the image to the pixels 121 of the thermochromic material. In some implementations, the image can be formed by applying heating energy sequentially to each individually selected pixel of the thermochromic layer while an area that includes the individually selected pixel is flooded with UV radiation. In some embodiments, the heating energy is spatially patterned in a two dimensional image plane 199 such that multiple individually selected pixels of the thermochromic layer are simultaneously heated to different temperatures while the multiple individually selected pixels are being flooded with UV radiation.

In both of the above scenarios, some of the individually selected pixels can be heated to a temperature that is different from the temperature to which other pixels of the individually selected pixels are heated. For example, a first set of the multiple individually selected pixels may be heated to a first temperature that causes the first set of pixels to shift to a first color and a second set of the multiple individually selected pixels are heated to a different second temperature that causes the second set of pixels to shift to a different second color. Additional sets of pixels of the multiple individually selected pixels can be heated to third, fourth, and fifth, etc. temperatures respectively associated with third, fourth, and fifth, etc. different colors.

The control circuitry 150 may comprise a microprocessor-based controller 150 that executes stored instructions to generate the one or more control signals 151*a*-151*e*. In some embodiments, control circuitry 150 controls the amount of heat producing energy provided by the heat source via control signals 151*a* and/or the amount of UV radiation provided by the UV radiation source via control signals 151*b*. Control circuitry 150 may map the pixels of the image to the pixels of the thermochromic material to form the multi-color image. For example, control circuitry 150 may map pixels of the thermochromic material in a two dimensional image plane and control the spatial pattern and intensity of the heat producing energy in the two dimensional image plane in accordance with the image being produced.

Control signal 151*a* controls the heat source 140 such that each individually selected pixel is heated to a predetermined temperature during processing corresponding to the desired color of that pixel in accordance with the image being produced. For example, via control signal 151*a*, the control circuitry 150 can turn the heat source 130 on or off for all pixels or for non-selected pixels and/or can provide a different amount of heat producing energy to different sets of the individually selected pixels.

Control signal 151*b* controls the amount of UV radiation provided by the UV radiation source 140. Via control signal 151*b*, the controller 150 can turn some or all of the UV radiation source on or off and/or can control the intensity of the UV radiation so as to apply a predetermined dosage of UV radiation to the area of the pixels being heated. In some embodiments, the UV radiation source is a set of UV lamps and the total intensity of the UV radiation may be modulated by turning a subset of the lamps on or off.

The system 100 can include a movement mechanism comprising one or more of components 130*a*, 140*a*, 160. Under control of the circuitry 150 via control signal 151*c*, the movement mechanism component 130*a* changes the position and/or direction of the heat producing energy generated by the heat source 130. Under control of the circuitry 150 via control signal 151*d*, the movement mechanism component 140*a* changes the position and/or direction of the UV radiation. Under control of the circuitry 150 via control signal 151*e*, and movement mechanism component 160 moves the substrate 120. According to some embodiments, circuitry 150 may control the movement the heat producing energy, the UV radiation, and the substrate to form a multi-color image in a thermochromic layer disposed in or on a continuously moving substrate.

In some implementations, the position of the heat producing energy relative to the substrate can be controlled by translational movement of the heat source. In some implementations, the translational position of each heating element of the heat source does not change and the direction of the heat producing energy is controlled by rotational movement of the heating elements. In other embodiments, the translational and rotational position of each heating element of the heat source is static, and the direction of the heat producing energy is controlled by deflecting or reflecting the heat producing energy.

The position of the UV radiation relative to the substrate can be controlled by translational and/or rotational movement of the UV radiation source. In some embodiments, the position of the UV radiation relative to the substrate is controlled by translational motion of the UV source. In some embodiments, the translational position of the UV source is constant and the direction of the UV radiation is controlled by rotational movement of the UV source. In other embodiments, the UV radiation source is translationally and rotationally fixed and the direction of the UV radiation can be controlled by reflecting the UV radiation.

The control circuitry and the movement mechanism can operate together to move a two dimensional image plane of spatially patterned heat producing energy and to change the direction of the UV radiation so that the area flooded with UV radiation tracks the two dimensional image plane across the surface of the thermochromic material. According to some embodiments, the movement mechanism is also configured to control the movement of the substrate while moving the two dimensional image plane and changing the direction of UV radiation. Circuitry 150 may control the movement and/or direction of the heat producing energy and/or the UV radiation to form a multi-color image in the thermochromic material on a continuously moving substrate.

In some embodiments, the heat source 130 may comprise a single heating element and the heat producing energy from the single heating element is scanned across the thermochromic material to heat the individually selected pixels. For example, the single heating element may comprise a resistive heating element, a jet configured to expel a stream of hot gas, or a laser source configured to emit laser radiation.

In some embodiments, the heat source 130 produces spatially patterned heat producing energy in a two dimensional image plane. For example, in some implementations the heat source 130 may comprise multiple heating elements arranged in a two dimensional heating element array that generates a spatial pattern of heat producing energy in a two dimensional image plane. Each heating element of the array can produce a different amount of heat producing energy so as to simultaneously heat individual pixels of the thermochromic material to different temperatures according to the image being produced. In other implementations the heat source 130 may comprise a single heating element in combination with a spatial heat pattern generator. The single heating element in combination with the spatial heat pattern generator creates a spatial pattern of heat producing energy in a two dimensional image plane. The combination of the single heating element and the spatial heat pattern generator can simultaneously heat individual pixels of the thermochromic material to different temperatures according to the image being produced.

Figure 1B:
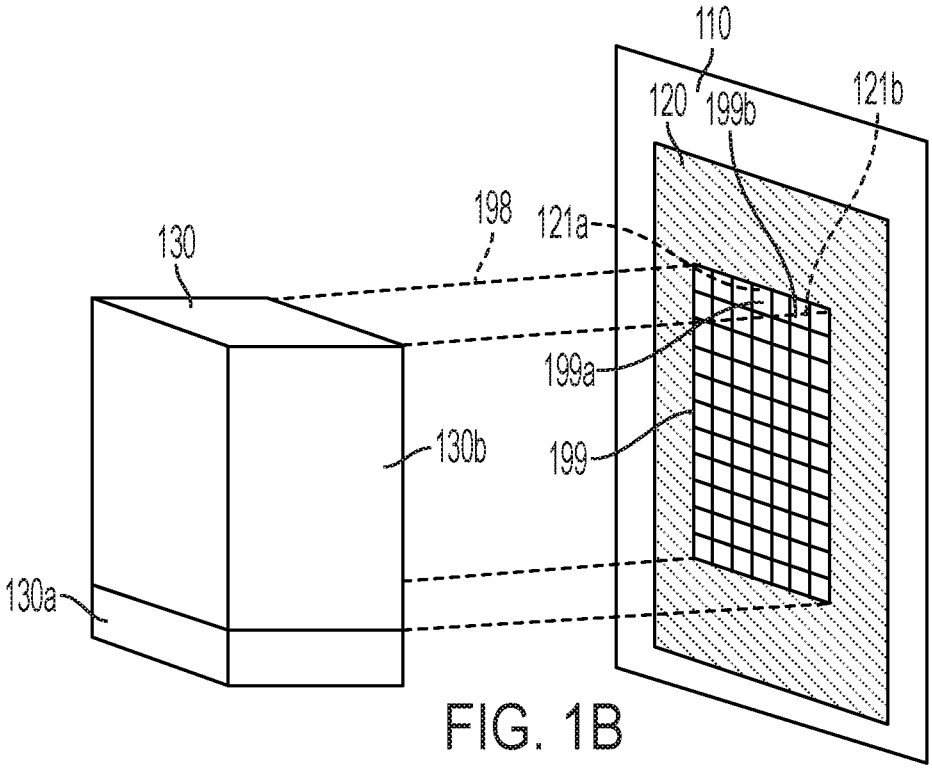
FIG. 1B shows a perspective view of a heat source and a two dimensional image plane of heat producing energy that varies in intensity projected onto pixels of thermochromic material in accordance with some embodiments.
Figure 1C:
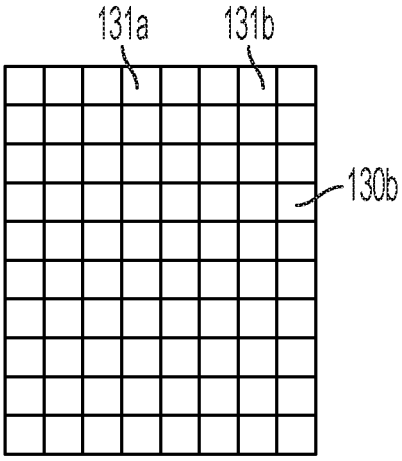
FIG. 1C shows a view of a two dimensional array of heating elements of the heat source which produces the two dimensional image plane of heat producing energy of FIG. 1B.
Figure 1D:
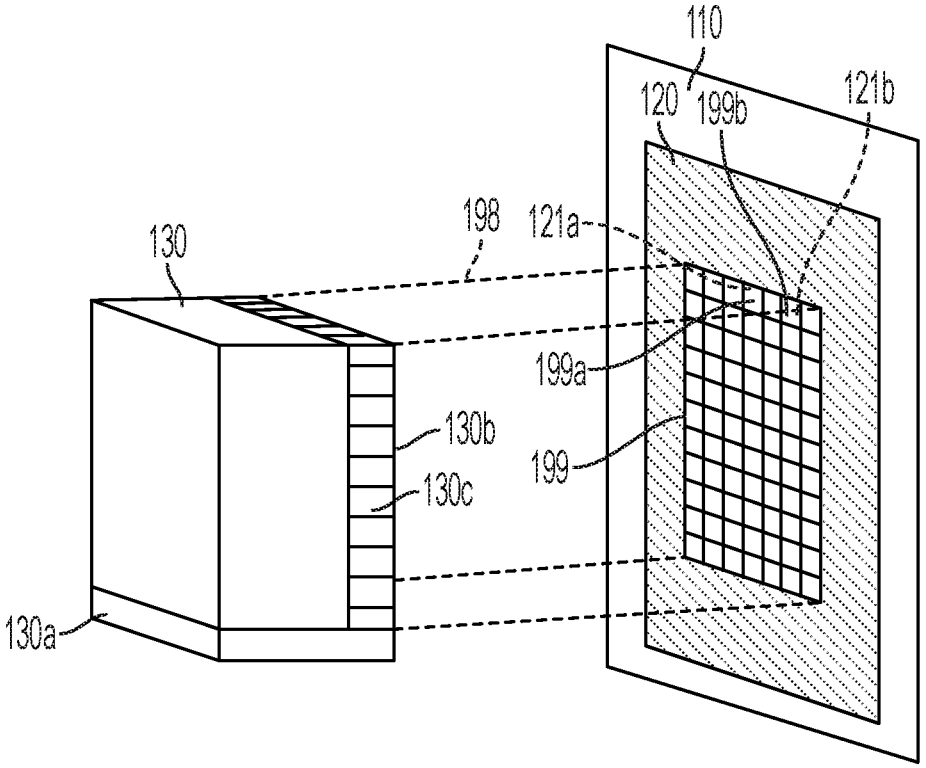
FIG. 1D shows a perspective view of a heat source as in FIGS. 1B and 1C that also includes multiple elements disposed between the heat source and the pixels in accordance with some embodiments.
Figure 1E:
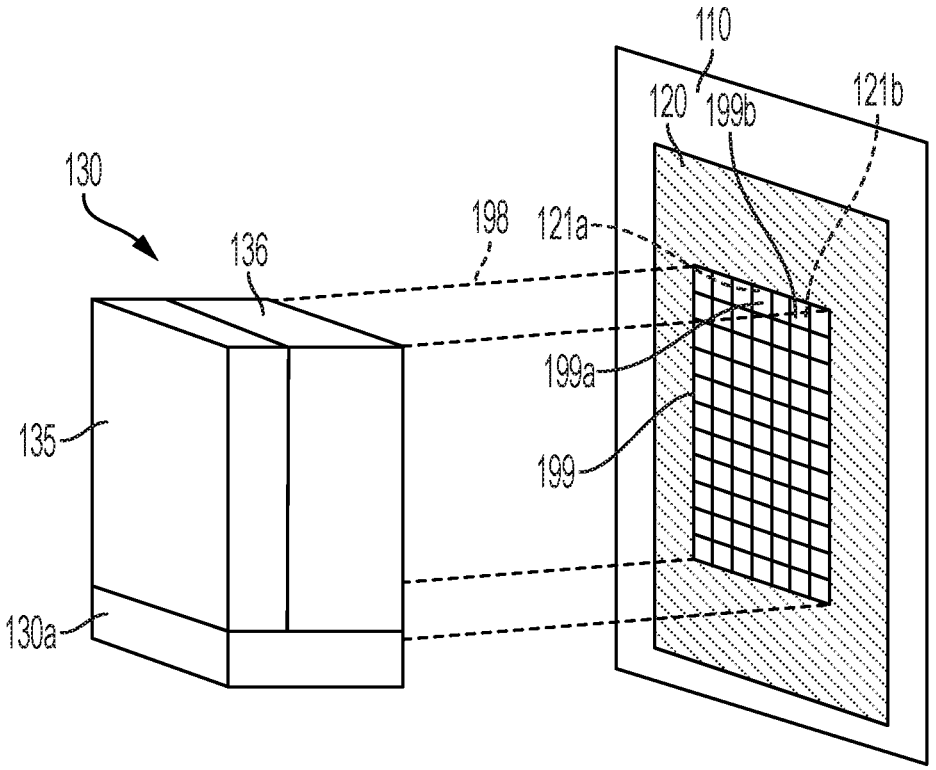
FIG. 1E shows a perspective view of a heat source as in FIGS. 1B and 1C that also includes an element disposed between the heat source and the pixels in accordance with some embodiments.

FIG. 1B shows a perspective view of a heat source 130 and a two dimensional image plane 199 of heat producing energy 198 projected onto pixels 121*a*, 121*b* of thermochromic material 120 disposed on a substrate 110. FIG. 1C shows a view of a two dimensional array 130*b* of heating elements 131*a*, 131*b* of the heat source 130 which produces the two dimensional image plane 199 of heat producing energy 198. Each heating element 131*a*, 132*b* may produce a different amount of heat producing energy to provide the spatial heating pattern of the two dimensional image plane 199. FIG. 1D shows a perspective view of a heat source 130 as in FIGS. 1B and 1C that also includes multiple elements 130*c* disposed between the heat source 130 and the pixels 121*a*, 121*b*. FIG. 1E shows a perspective view of a heat source 130 as in FIGS. 1B and 1C that also includes an element 136 disposed between the heat source 130 and the pixels 121*a*, 121*b*.

Multiple individually selected pixels 121*a*, 121*b* of the thermochromic material 120 that correspond to pixels 199*a*, 199*b* of the two dimensional image plane 199 are simultaneously exposed to the spatially patterned heat producing energy 198 generated by heating elements 131*a*, 131*b*. The spatially patterned heat producing energy 198 may heat some of the multiple individually selected pixels 121*a* to a first temperature and heat some of the multiple individually selected pixels 121*b* to a different second temperature.

The heat producing energy 198 may flow directly from the heating elements 131*a*, 131*b* to the pixels 121*a*, 121*b* in some implementations as indicated in FIG. 1B. In some implementations, illustrated in FIGS. 1D and 1E, there may be one or more elements 130*c*, 136 disposed between the heating elements 131*a*, 131*b* and the pixels 121*a*, 121*b*. The elements 130*c*, 136 may comprise energy modulators, energy spatial pattern generators, guiding elements, reflectors, deflectors, etc. The elements 130*b*, 136 may modulate, pattern, guide, reflect and/or deflect the heat producing energy 198 to produce the two dimensional image plane 199 as further discussed in the examples below.

In some configurations, the movement mechanism component 130*a* may be controlled by the controller 150 via control line 151*c* (see FIG. 1A) to change the position of the two dimensional image plane 199 of spatially modulated heat energy 198 by translationally moving the entire two dimensional array 130*b* of heating elements 131*a*, 131*b*. During movement of the two dimensional array 130*b* of heating elements 131*a*, 131*b*, the heating elements 131*a*, 131*b* themselves may be stationary relative to each other within the two dimensional array 130*b*.

In some embodiments, under the control of control circuitry 150, the movement mechanism 130*a* is capable of independently or collectively rotating each heating element 131*a*, 131*b* of the heat source 130 to change the direction of the heat producing energy 198 from the heating element 131*a*, 131*b*. In some scenarios, the heat source 130 is stationary and one or more heating elements 131*a*, 131*b* rotate to address different pixels 121*a*, 121*b* of the thermochromic material 120.

In some embodiments, the movement mechanism 130*a* comprises one or more deflectors or reflectors 130*c*, 136 arranged relative to the heating elements 131*a*, 131*b* so that the deflectors or reflectors 130*c*, 136 are capable of being moved translationally and/or rotationally to change the direction of the heat producing energy from the one or more heating elements 131*a*, 131*b*. In one scenario, the heat source 130 is stationary and one or more deflectors or reflectors 130*c*, 136 of the movement mechanism 130*a* are rotated collectively or independently to redirect the heat producing energy 198 from the heating elements 131*a*, 131*b* to address different individually selected pixels 121*a*, 121*b* of the thermochromic material 120.

In some embodiments, the heat source 130 may comprise one or more resistive heating elements. Current flowing through the resistive heating elements generates the heat producing energy 198 for heating pixels 121*a*, 121*b* of the thermochromic material 120 to produce an image. For example, a resistive heat source 130 may comprise a two dimensional array 130*b* of resistive heating elements 131*a*, 131*b* capable of forming a two dimensional image plane 199 of spatially patterned heat energy 198. The array 130*b* of resistive heating elements 131*a*, 131*b* can be configured to heat a corresponding array of pixels 121*a*, 121*b* of the thermochromic layer 120. Each resistive element 131*a*, 131*b* may be individually controllable. For example, the controller 150 may independently control the current through each of the multiple heating resistive elements 131*a*, 131*b* allowing each resistive heating element 131*a*, 131*b* in the array 130*b* to provide a different amount of heat to different pixels 121*a*, 121*b*.

In some configurations, the movement mechanism component 130*a* may be controlled by the controller 150 via control line 151*c* (see FIG. 1A) to change the position of the two dimensional image plane 199 of spatially modulated heat energy 198 by translationally moving the entire two dimensional array 130*b* of resistive heating elements 131*a*, 131*b*. During movement of the two dimensional array 130*b* of resistive heating elements 131*a*, 131*b*, the resistive heating elements 131*a*, 131*b* themselves may be stationary relative to each other within the two dimensional array 130*b*.

In some embodiments, the heat source 130 may comprise a source of a heated gas, such as heated air, and one or more gas jets that direct the heated gas toward the thermochromic material. The heat source may comprise an array 130*b* of multiple gas jets 131*a*, 131*b*, wherein each gas jet is capable of directing a different amount of heated gas toward the pixels 121*a*, 121*b* of the thermochromic layer 120.

An array 130*b* of independently controllable gas jets 131*a*, 131*b* can create a two dimensional image plane 199 of spatially patterned heat producing energy 198. The gas jets 131*a*, 131*b* direct heated gas, e.g., heated air, toward the pixels 121*a*, 121*b* of the thermochromic layer 120. The controller 150 may control the gas jets 131*a*, 131*b* such that different pixels 121*a*. 121*b* of the thermochromic layer 120 are exposed to different amounts of heat energy 198 from the gas jets and are thus heated to different temperatures.

In some embodiments, under the control of control circuitry 150, the movement mechanism 130*a* is capable of independently or collectively rotating each gas jet 131*a*, 131*b* of the heat source 130 to change the direction of the heated gas from the jet 131*a*, 131*b*. In some scenarios, the heat source 130 is stationary and one or more gas jets 131*a*, 131*b* rotate to address different pixels 121*a*, 121*b* of the thermochromic material 120.

In some embodiments, the movement mechanism 130*a* comprises one or more deflectors 130*c* arranged relative to the gas jets 131*a*, 131*b* so that the deflectors 130*c* are capable of being rotated to change the direction of the heated gas streams expelled from the one or more gas jets 131*a*, 131*b*. In one scenario, the heat source 130 is stationary and one or more deflectors 130*c* of the movement mechanism 130*a* are rotated collectively or independently to redirect the heated gas from the gas jets 131*a*, 131*b* of the heat source 130 to address different individually selected pixels 121*a*, 121*b* of the thermochromic material 120. A heat source 130 capable of producing a two dimensional spatial heat pattern may comprise multiple gas jets 131*a*, 131*b*, each gas jet 131*a*, 131*b* associated with a deflector 130*c* configured to change the direction of the associated gas jet.

In some embodiments, the heating elements 131*a*, 131*b* of the heat source 130 may comprise one or more lasers that direct heat producing radiation 198 toward the thermochromic material 120. For example, in some embodiments, the laser radiation may be visible, infrared (IR) or near infrared (NIR) radiation that heats the thermochromic material, although other radiation wavelengths may also be useful for heating the thermochromic material.

In some embodiments, the heat source 130 may comprise a two dimensional array 130*b* of lasers 131*a*, 131*b* such that each laser 131*a*, 131*b* respectively corresponds to a pixel 121*a*, 121*b* of the thermochromic layer 120. The two dimensional array 130*b* of lasers 131*a*, 131*b* is capable of generating a two dimensional image plane 199 of spatially patterned laser radiation 198. In some embodiments, one or more guiding elements 130*c*, e.g., waveguides or optical fibers, may be disposed between each laser 131*a*, 131*b* and a corresponding pixel 121*a*, 121*b* of the thermochromic material 120. For example, the lasers 131*a*, 131*b* are optically coupled to an input end of a corresponding optical fiber that directs the laser radiation toward the thermochromic material 120. In this embodiment, the lasers themselves need not be arranged in a two dimensional array because the output ends of the optical fibers can be arranged in a two dimensional array providing a spatial radiation pattern that forms a two dimensional image plane 199 of spatially modulated radiation. The controller 150 may comprise circuitry that individually modulates the intensity of each laser 131*a*, 131*b* so as to provide a different amount of laser radiation to different pixels 121*a*, 121*b*.

The movement mechanism component 130*a* can be operated the change the direction of the laser radiation. In some embodiments, the movement mechanism component 130*a* comprises a step motor or other mechanism that translationally and/or rotationally moves the entire two dimensional array 130*b* of lasers 131*a*, 131*b* and/or the entire two dimensional array of associated optical fibers to direct radiation to individually selected pixels 121*a*, 121*b*.

In some embodiments, the movement mechanism component 130*a* comprises one or more rotatable mirrors. In some scenarios, a single rotatable mirror changes the direction of the radiation from radiation source 130. In an alternative scenario, the movement mechanism components 130*a* comprises multiple rotatable mirrors 130*c* and each laser 131*a*, 131*b* is associated with a corresponding rotatable mirror 130*c* that can be rotated to redirect the radiation from that laser 131*a*, 131*b*.

As illustrated in FIG. 1E according to some embodiments, the heat source 130 comprises a single laser 135 that is optically coupled to a device 136 that spatially patterns the radiation from the single laser 135. The spatially patterned radiation 198 forms a two dimensional image plane 199 of the heat producing radiation 198 that varies in radiation intensity. For example, the spatial radiation pattern generator 136 may comprise one or more of a liquid crystal spatial radiation modulator such as a liquid crystal on silicon (LCOS), a digital micromirror device (DMD), a grating light valve (GLV), and an acousto-optic modulator (AOM). The spatial pattern generator 136 is configured to spatially pattern the radiation from a single laser 135 or from multiple lasers over a two dimensional image plane 199. Under system control the one or more lasers 135 and the spatial radiation pattern generator 136 provide pixel-by-pixel control of the intensity of radiation over the two dimensional image plane 199. Multiple individually selected pixels 121*a*, 121*b* of the thermochromic material 120 that correspond to pixels 199*a*, 199*b* of the two dimensional image plane 199 are simultaneously exposed to the spatially patterned radiation that spatially varies in radiation intensity. Some of the multiple individually selected pixels 121*a* are exposed to an amount of radiation that is different from the amount of radiation to which other pixels 121*b* of the multiple individually selected pixels are exposed.

In some embodiments, a movement component 130*a* is used in conjunction with the one or more lasers 135 and spatial radiation patterning device 136. For example, the movement component 130*a* may comprise one or more moveable mirrors configured to change the direction of the spatially patterned radiation emerging from the spatial radiation patterning device 136. In some embodiments, the movement component 130*a* causes a two dimensional image plane produced by the spatial radiation patterning device 136 to move in synchrony with the substrate such that there is negligible relative motion between the substrate and the two dimensional image plane.

Figure 2:
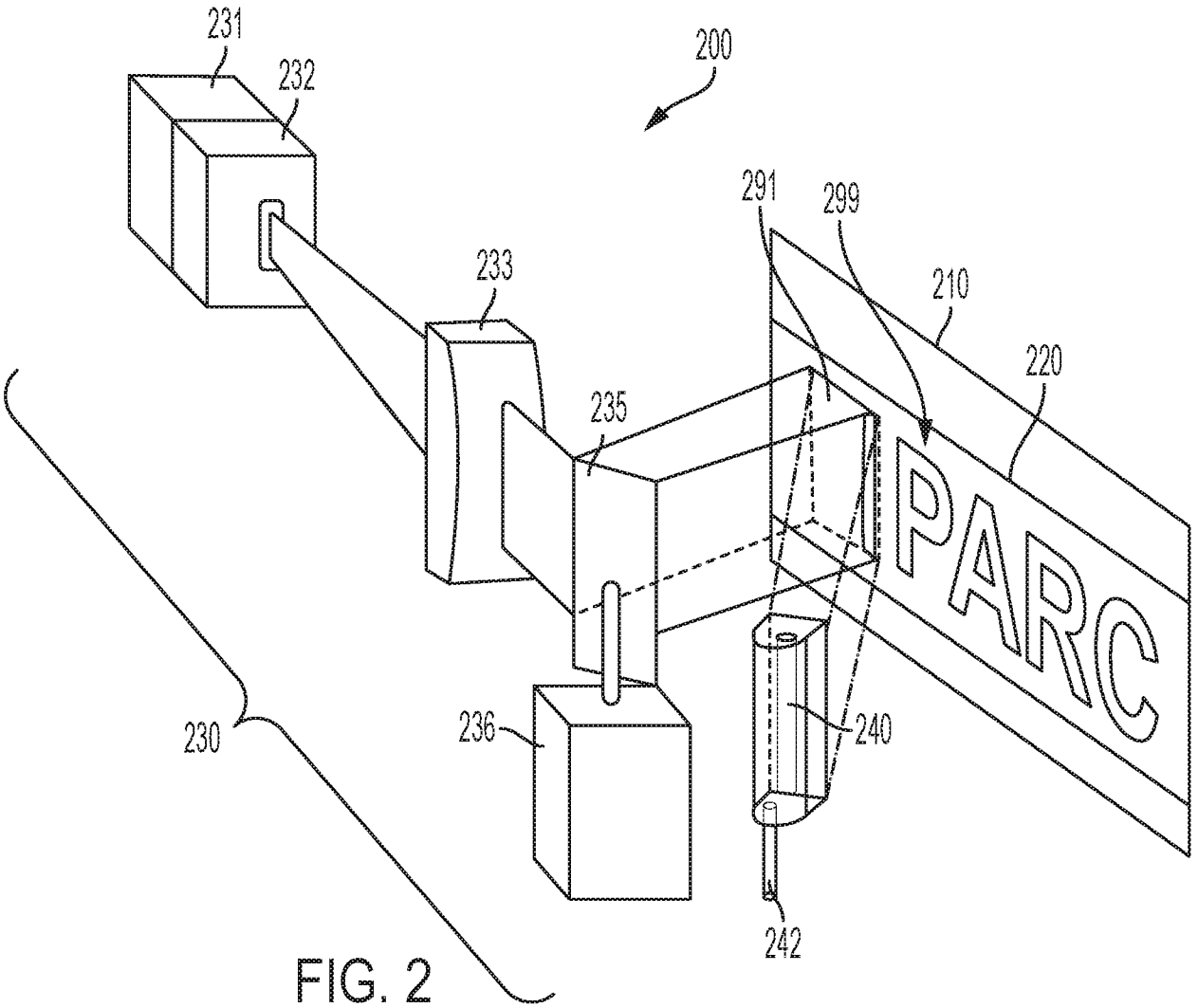
FIG. 2 is a perspective view of a block diagram of an apparatus for forming an image on a substrate in accordance with some embodiments.

FIG. 2 is a perspective view of a block diagram of an apparatus 200 for forming an image on a substrate in accordance with some embodiments. The apparatus 200 includes a heat source 230 and a UV radiation source 240. The apparatus 200 may include control circuitry as previously discussed although the control circuitry is not shown in FIG. 2.

The heat source 230 includes a radiation generating device 231, such as an IR/NIR laser. The laser 231 is optically coupled to a radiation patterning device 232 configured to spatially pattern the laser radiation such that the pixels of the thermochromic material disposed on a substrate 210 can be individually accessible by the heat producing radiation without significantly irradiating neighboring pixels. In general a "top hat" radiation profile for each pixel with leading and falling edges at the pixel boundaries having infinite slope is desirable, however, in practice the spatial profile may be more Gaussian. The radiation patterning device 232 may be a liquid crystal spatial modulator in some embodiments or may be another type of spatial radiation modulator as previously discussed. The resolution of the patterning device 232 may provide an image of 300 dots (pixels) per inch (ppi), 400, ppi, 600 ppi, or 1200 ppi, for example. The patterning device 232 may be optically coupled through one or more optical components 233, e.g., lenses, to a movable mirror 235. A mirror movement mechanism 236 can be controlled by control circuitry (not shown in FIG. 2) to rotate the mirror 235. In some embodiments, the mirror 235 may be translationally stationary and capable of rotational movement. In other embodiments, the mirror may be configured to move translationally and not rotationally. In yet other embodiments, the mirror may be configured to move both translationally and rotationally.

As illustrated in FIG. 2, the spatial patterning device 232 is configured generate a two dimensional image plane 291 of spatially patterned radiation that spatially varies in radiation intensity and irradiates the substrate 210 having a thermochromic layer 220 disposed thereon. The mirror movement mechanism 236 is controlled to rotate the mirror 235 such that the two dimensional image plane 291 scans across the thermochromic material 220 disposed on the substrate 210. As the two dimensional image plane 291 of spatially patterned radiation scans across the thermochromic material, pixels of the thermochromic material are heated to a number of different temperatures, producing a corresponding number of different colors that form the image 299.

The UV radiation source 240 may be moved by movement mechanism 242, or can be configured so it is stationary. UV radiation from the UV radiation source 240 floods the 2D image plane 291 while the pixels of thermochromic material in the two dimensional image plane are being heated. The radiation flood area of the UV radiation source 240 has the same dimensions as the 2D image plane 291, or may be larger than the 2D image plane 291.

In one embodiment, the movement mechanisms 235, 242 are controlled by the control circuitry to cause the UV radiation flood of the UV radiation source 240 to track the two dimensional image plane 291 produced by the heat source 230. In another embodiment, the UV radiation source 240 is stationary but floods the entire area swept by the two dimensional image plane 291 as the plane is scanned across the thermochromic material 220 via movement mechanism 235.

Figure 3A:
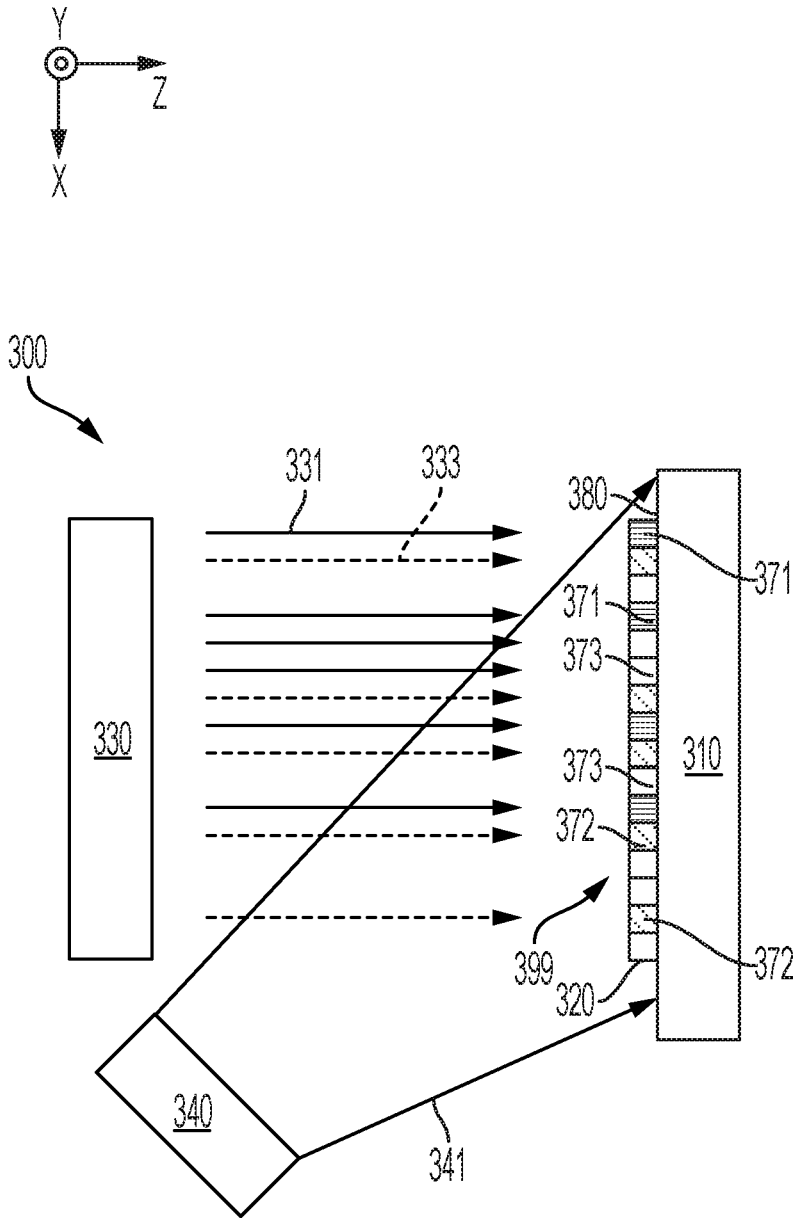
FIGS. 3A and 3B illustrate the operation of an image producing apparatus 300 in accordance with some embodiments.
Figure 3B:
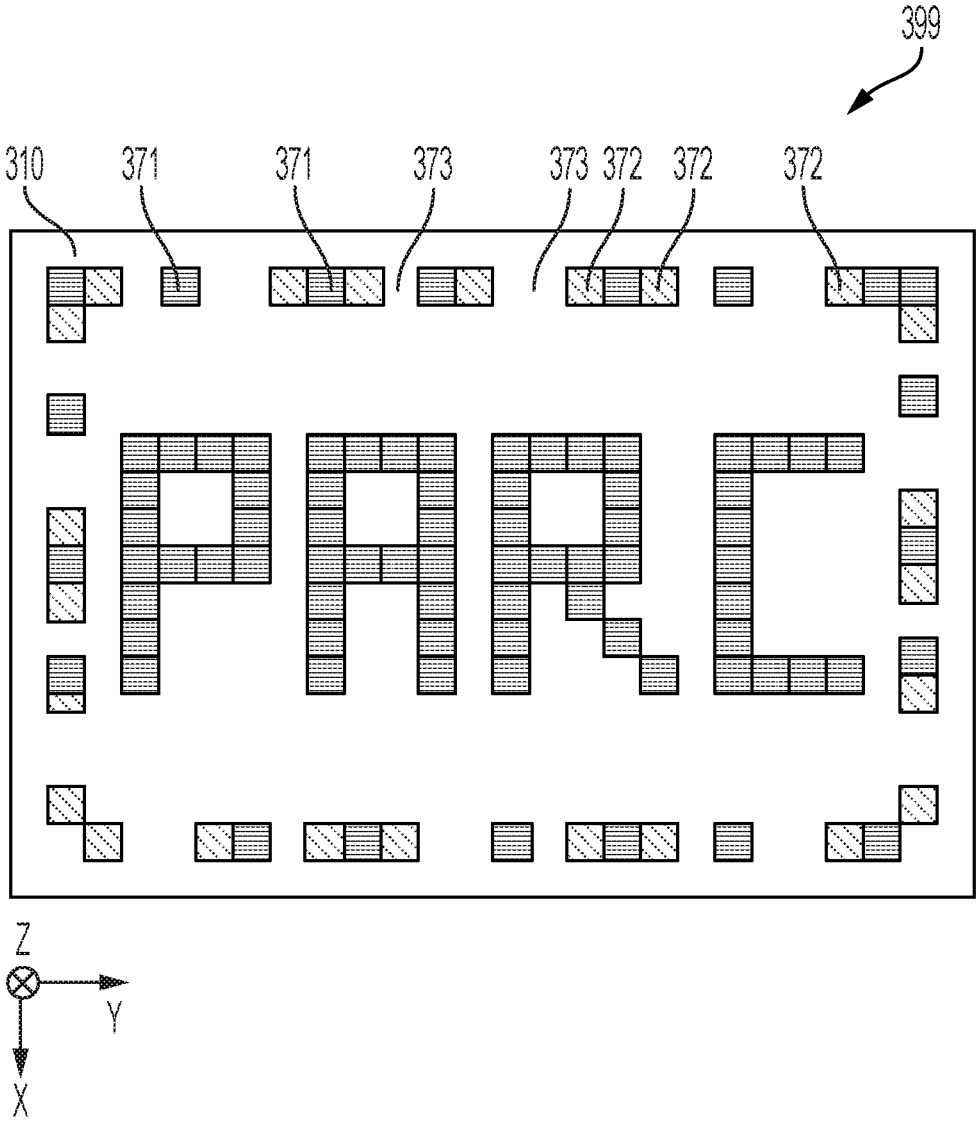

FIGS. 3A and 3B illustrate the operation of an image producing apparatus 300 in accordance with some embodiments. FIG. 3A shows a side view of the substrate 310 and thermochromic layer 320. FIG. 3B shows a top view of the image 399 formed in the thermochromic layer 320 on the substrate 310. The heat source 330 comprises a laser, e.g., a laser that produces radiation having wavelengths in the IR or NIR range. FIG. 3A also shows a UV radiation source 340 configured to generate UV radiation 341.

The heat source 330 irradiates selected individually accessible pixels 371, 372, 373 of the thermochromic layer 320 to form an image 399. The heat source 330 is capable of applying different amounts of radiation to different pixels. As shown in FIG. 3A, a first subset of pixels 371 is being exposed to a first radiation amount 331, a second subset of pixels 372 is being exposed to a second radiation amount 333, and a third set of pixels 373 is not being exposed to radiation from the heat source 330. The amount of radiation that a pixel receives corresponds to the amount that pixel is heated. Different amounts of heating produce different colors of the thermochromic layer 380. The UV radiation source 340 is configured to flood the area 380 surrounding the pixels 371, 372, 373 with UV radiation during the time that the pixels are being heated. The radiation dosages 331 and 341 are sufficient to cause the thermochromic material 320 in pixels 371 to change to a first color. The radiation dosages 333 and 341 are sufficient to cause the thermochromic material 320 in pixels 372 to change to a second color different from the first color. The thermochromic material 320 in pixels 373 are not being heated and do not change color. For example, the thermochromic material in pixels 373 may remain colorless. FIG. 3B shows a top view of the two dimensional image 399 formed using the process outlined above comprising pixels 371 of a first color, pixels 372 of a second color, and pixels 373 that remain colorless.

Figure 4:
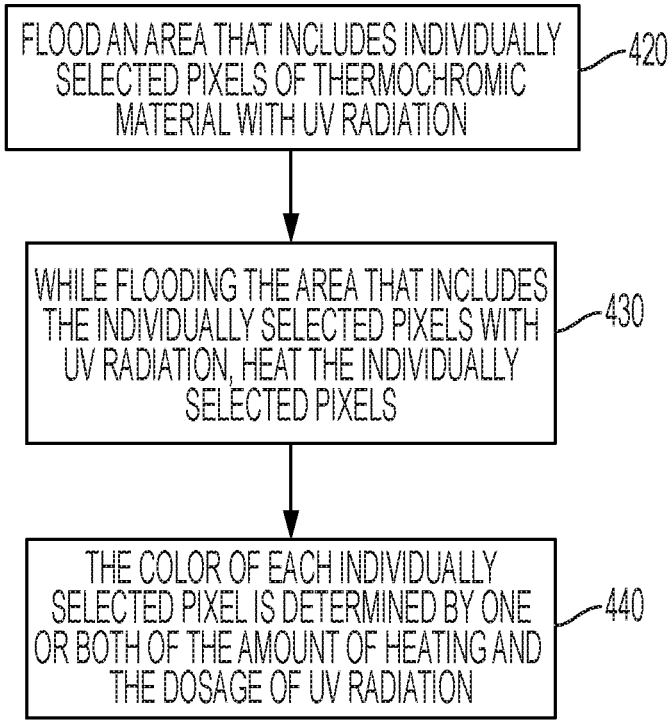
FIG. 4 is a flow diagram of a process of forming a multi-colored image on a substrate that includes a thermochromic material capable of producing at least two different colors in accordance with some embodiments.

FIG. 4 is a flow diagram of a process of forming a multi-colored image on a substrate that includes a thermochromic material capable of producing at least two different colors in accordance with some embodiments. Flood an area of the thermochromic material with UV light 430. While the UV illumination is on, heat one or more individually selected pixels of the thermochromic material that correspond to the image 420, so the degree of heating and dosage of UV radiation is sufficient to at least partially polymerize the thermochromic material. A color of each individually selected pixel is determined 440 by one or both of an amount of the heating of the pixel and the UV radiation dosage.

As previously discussed, in some embodiments, the movement mechanism alters the direction of the heat producing energy from the heat source, e.g., by moving the heat source, collectively or individually moving the heating elements of the heat source and/or by redirecting the heat producing energy. The movement mechanism may also alter the direction of the UV radiation, e.g., by moving the UV radiation source and/or by redirecting the UV radiation. In some embodiments, the movement mechanism may alter the direction of the heat producing energy and the UV radiation so that the two dimensional image plane formed by the heat source and the flood area of the UV radiation source move in synchrony with the moving substrate.

Figure 5A:
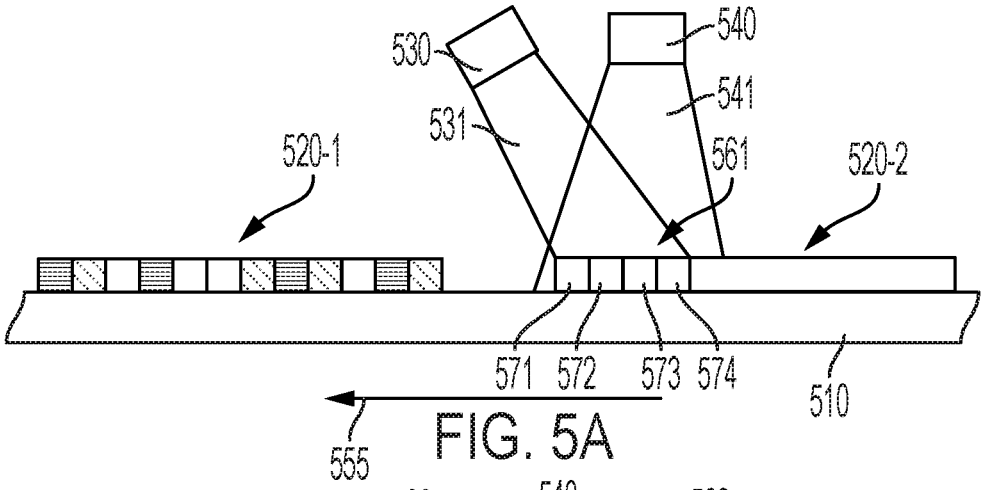
FIGS. 5A through 5E illustrate a process of forming an image on a moving substrate in accordance with some embodiments.

FIGS. 5A through 5E illustrate a process of forming an image on a moving substrate in accordance with some embodiments. FIGS. 5A through 5E show a side view of a portion of the heat source 530, which in this example is a laser radiation source, the UV radiation source 540, and the substrate 510 which includes a segmented layer of thermochromic material 520-1, 520-2, 520-3 disposed thereon. In FIG. 5A, the substrate 510 and radiation sources 530, 540 are shown at time t1. The substrate 510 is moving from right to left. An image has been formed on a first segment 520-1 of the thermochromic layer. Image formation is in process for a second segment 520-2 of the thermochromic layer. The laser 530 emits spatially modulated laser radiation 531 that heats individually selected pixels 571, 572, 574 of the second segment 520-2 of thermochromic material while the UV radiation source 540 floods the area 561 of the individual pixels 571, 572, 574 with UV radiation 541 sufficient to at least partially polymerize the individually selected pixels 571, 572, 574. Pixels 571, 572, 574 are simultaneously exposed to laser radiation. Pixels 571, 574 are exposed to a first amount of laser radiation that heats pixels 571, 574 to a first temperature. Pixel 572 is exposed to a second amount of laser radiation that heats pixel 572 to a second temperature different from the first temperature. Pixel 573 is not being heated because pixel 573 is not one of the pixels individually selected for heating.

Figure 5B:
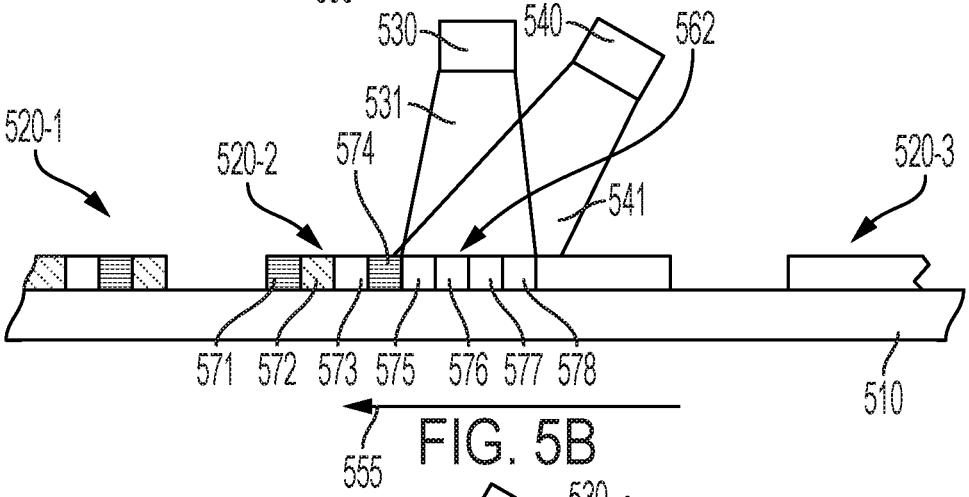

FIG. 5B is a view of the heat source 530, UV radiation source 540, and substrate 510 with segments 520-1, 520-2, 520-3 of thermochromic material disposed thereon at time t2. The substrate 510 is moving from right to left. The direction of the radiation 531 from the laser radiation source 530 and the direction of the UV radiation 541 from the UV radiation source 540 have changed from previous directions at time t1 to track the movement of the substrate 510. At time t2, the first segment 520-1 of thermochromic material is moving from view and a third segment 520-3 of thermochromic material is moving into view. Image formation is still in process for a second segment 520-2 of the thermochromic layer. The image has been formed in pixels 571-574.

During time t1, individually selected pixels 571, 572, 574 were simultaneously exposed to spatially modulated laser radiation. Individually selected pixels 571 and 574 received a first amount of radiation which heated pixels 571, 574 to a first temperature; individually selected pixel 572 received a second amount of radiation which heated pixel 572 to a second temperature different from the first temperature. Pixel 573 was not heated. As a result, pixel 572 has changed to a color that is different from the color of pixels 571 and 574 and pixel 573 has not changed color, e.g., remains colorless.

At time t2, the laser 530 is emitting spatially modulated laser radiation 531 that simultaneously heats individually selected pixels 577, 578 of the second segment 520-2 while the UV radiation source 540 floods the area 562 of the individual pixels 577, 578 with UV radiation 541 sufficient to at least partially polymerize the individually selected pixels 577, 578. The spatially modulated radiation provides the first amount of radiation to pixel 578 and the second amount of radiation, different from the first amount to pixel 577. The first amount or radiation heats pixel 578 to the first temperature and the second amount of radiation heats pixel 577 to the second temperature. Pixels 575 and 576 are not being heated by the laser radiation because pixels 575 and 576 are not pixels that are individually selected for heating.

Figure 5C:
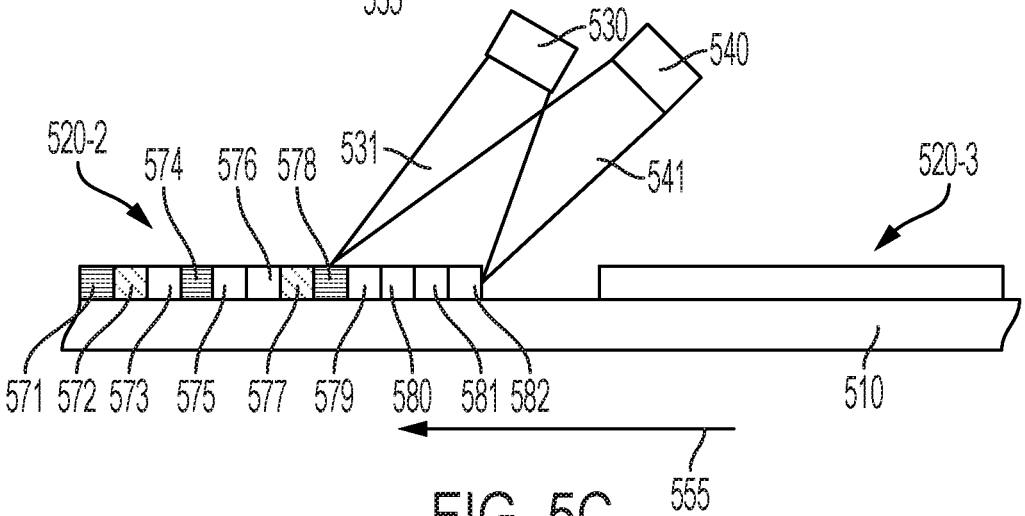

FIG. 5C is a view of the heat source 530, UV radiation source 540, and substrate 510 with segments 520-2, 520-3 of thermochromic material disposed thereon at time t3. The substrate 510 is moving from right to left and the direction of the radiation 531 from the laser radiation source 530 and the direction of the UV radiation 541 from the UV radiation source 540 changes to track the movement of the substrate 510. At time t3, the first segment 520-1 of thermochromic material has moved out of view and a third segment 520-3 of thermochromic material has moved completely into view. Image formation is still in process for the second segment 520-2 of the thermochromic layer. A portion of the image has been formed in pixels 571-578. Individually selected pixels 571, 574, 578 received a first amount of heat; individually selected pixels 572, 577 received a second amount of heat different from the first amount of heat received by pixels 571, 574, 578; and pixels 573, 575, 576 were not heated. As a result, pixels 571, 574, and 578 have changed to a first color and pixels 572, 577 have changed to a second color that is different from the first color. Pixels 573, 575, 576 have not changed color, e.g., pixels 573, 575, 576 remain colorless.

At time t3, the laser 530 is emitting laser radiation 531 that heats individually selected pixels 579, 581, 582 of the second segment 520-2 while the UV radiation source 540 floods the area 563 of the individual pixels 579, 581, 582 with UV radiation 541 sufficient to at least partially polymerize the individually selected pixels 579, 581, 582 Note that pixel 580 is not being heated because pixel 580 was not one of the pixels individually selected for heating.

Figure 5D:
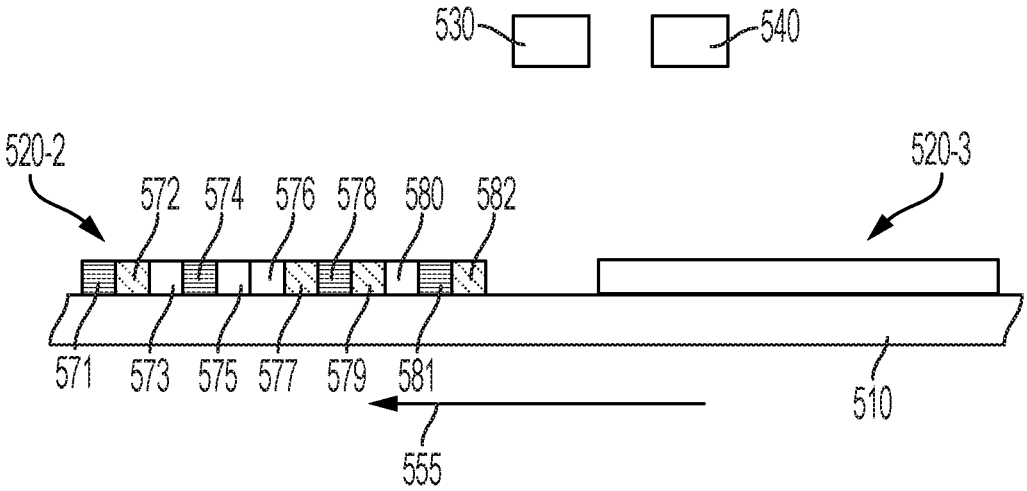

FIG. 5D shows the heat source 530, UV radiation source 540, and substrate 510 having segments 520-2, 520-3 of thermochromic material disposed thereon at time t4. The substrate 510 is still moving from right to left. At time t4, the second and third segments 520-2, 520-3 of thermochromic material are in view. The heat source 530 and UV radiation source 540 are turned off and the heat source laser 530 and UV radiation source 540 are repositioning to begin imaging segment 520-3.

Image formation for the second segment 520-2 of the thermochromic layer is complete. Individually selected pixels 571, 574, 578, 581 received a first amount of heat; individually selected pixels 572, 577, 582 received a second amount of heat different from the first amount; and pixels 573, 575, 576, 580 were not heated. As a result, pixels 571, 574, 578, 581 have changed to a first color and pixels 572, 577, 582 have changed to a second color different from the first color. Pixels 573, 575, 576, 580 were not heat treated and have not changed color, e.g., pixels 573, 575, 576, 580 remain colorless.

Figure 5E:
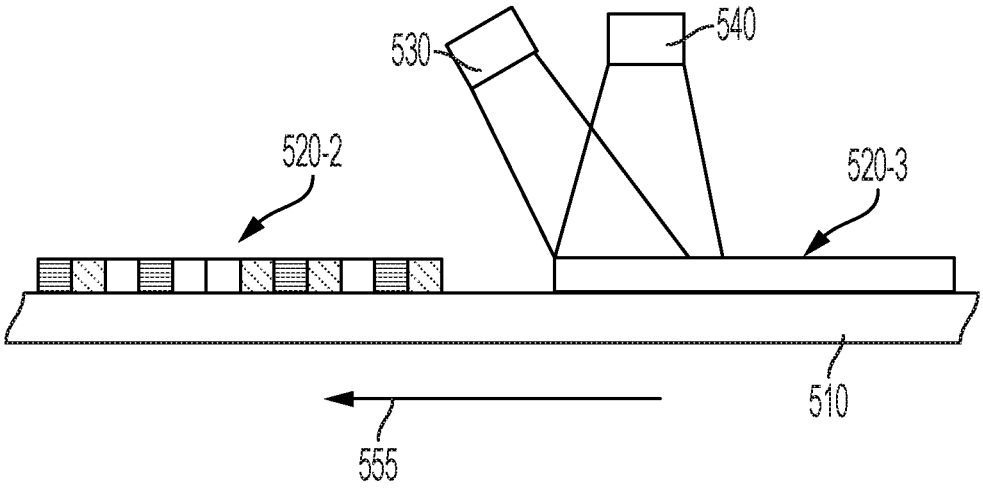

In FIG. 5E, the substrate 510 and radiation sources 530, 540 are shown at time t5. Image formation is for the third segment 520-3 of the thermochromic layer is underway is underway according to the process already discussed with regard to segment 520-2.

In an alternative embodiment, the UV radiation source 540 remains on and stationary from time t1 to time t5, but illuminates a larger area encompassing pixel 574 in FIG. 5A to pixel 578 in FIG. 5C as laser light source 531 is scanned across the moving substrate 510.

Example

Approaches discussed herein involve new approaches for image formation using thermochromic material involving a new system and process. The new approaches include heating pixels of the thermochromic material with laser radiation while simultaneously flooding the area of the pixels with UV radiation from a UV source to form a multi-color image. In this example, the ability to lock the thermochromic material into different colors when the thermochromic material is processed at different temperatures is demonstrated.

Figure 6:
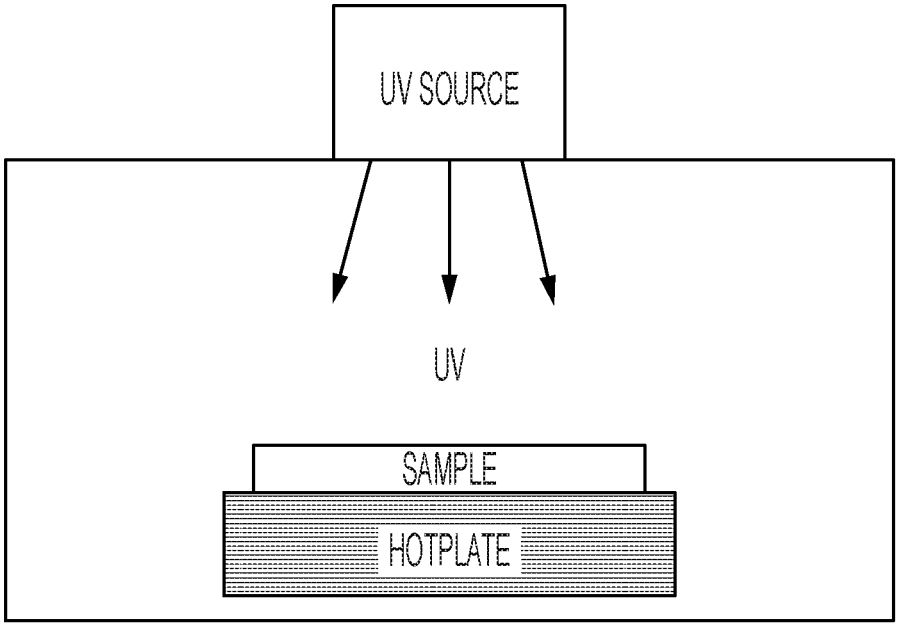
FIG. 6 shows the setup used to process samples in an experiment involving image formation using thermochromic materials.

FIG. 6 shows the experimental setup used to process the samples. The samples were substrates with a thermochromic coating comprising diacetylene mixed with near IR absorbers at 0.5% concentration. Each sample was placed on a hotplate which was used to simulate heating with a heating source such as laser radiation where different temperatures provided by the hotplate correspond to different amounts of laser radiation. The sample was heated for at least 5 minutes and simultaneously exposed to constant UV radiation from a UV source at a wavelength of 254 nm and dosage of 400 $mJ/cm^2$. We demonstrated the ability to lock the thermochromic material into different colors when processed at different temperatures using the new approach disclosed herein.

Figure 7B:
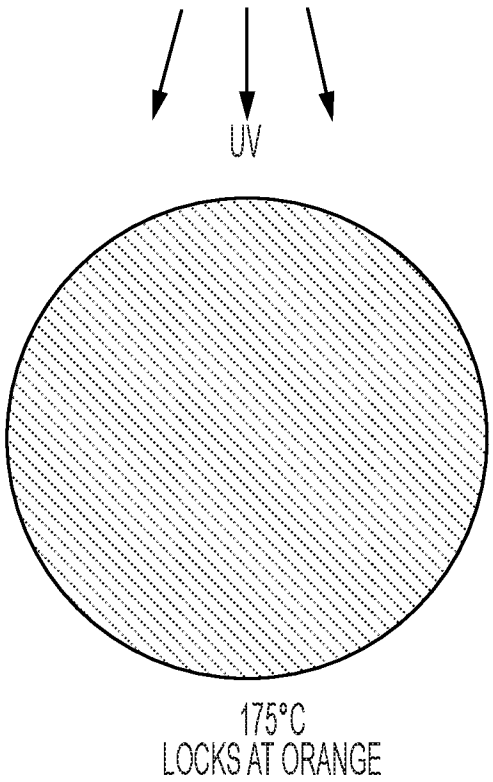
FIGS. 7A and 7B are photographs showing the samples and their locked colors after processing.
Figure 7A:
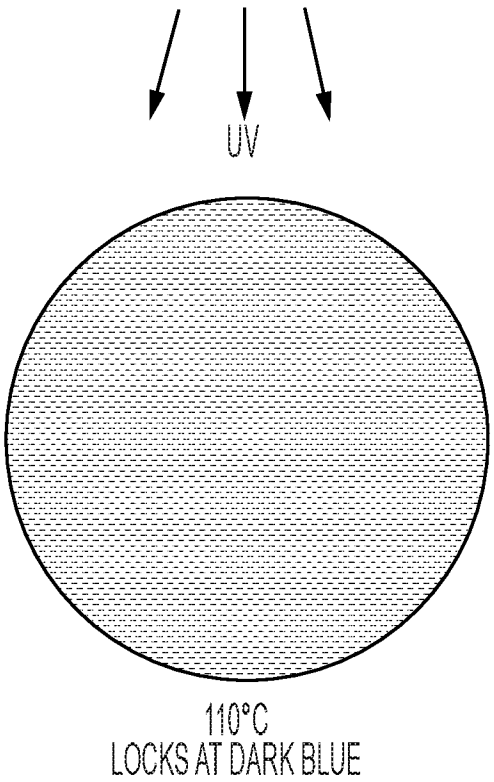

FIGS. 7A and 7B are photographs showing the samples and their locked colors after processing as described above. The first sample shown in FIG. 7A was processed at 110 degrees C. for about 5 min. with a temperature ramp time of about 10 min from room temperature under constant UV radiation at a wavelength of 254 nm and dosage of 400 $mJ/cm^2$ and locks in at dark blue. The second sample shown in FIG. 7B was processed at 175 degrees C. for about 5 min. with a temperature ramp time of about 10 min from room temperature under constant UV radiation at a wavelength of 254 nm and dosage of 400 $mJ/cm^2$ and locks in at orange.

Figure 8:
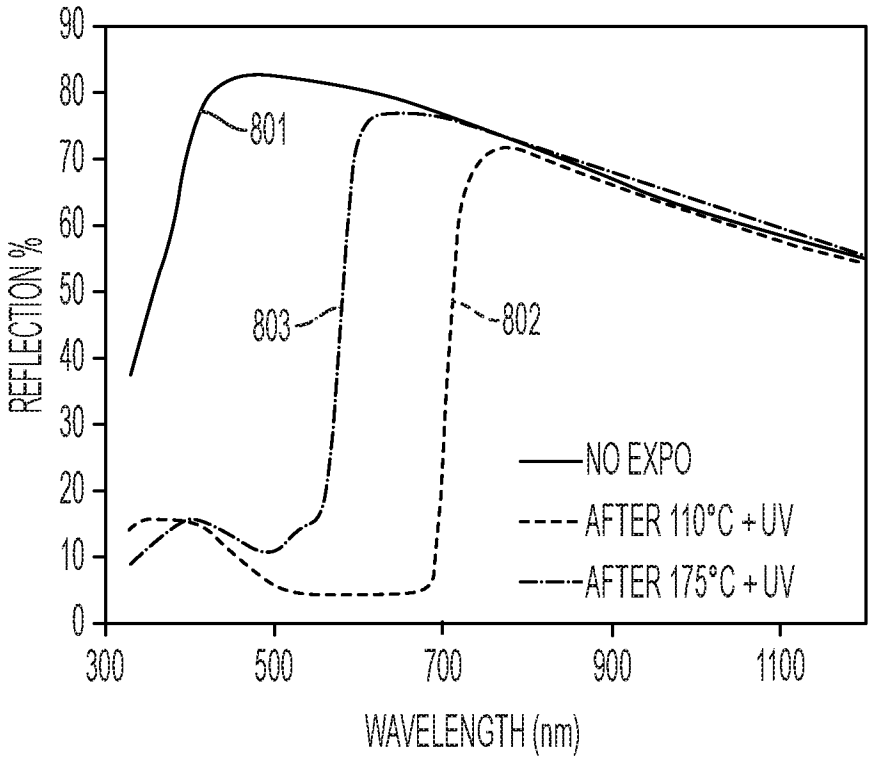
FIG. 8 provides superimposed plots showing the corresponding diffused reflectivity spectrum of the samples of FIGS. 7A and 7B before and after processing.

FIG. 8 presents superimposed plots that show the corresponding diffused reflectivity spectrum of the samples before and after processing. Plot 801 shows the diffuse reflectivity spectrum of the samples prior to exposure. Plot 802 shows the diffuse reflectivity of the first sample after exposure at 110 degrees C. and simultaneous UV radiation. Plot 803 shows the diffuse reflectivity of the first sample after exposure at 175 degrees C. and simultaneous UV radiation.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. A method of forming a multi-colored image on a substrate that includes a thermochromic material capable of producing at least two different colors, the method comprising:

heating individually selected pixels of the thermochromic material that correspond to the image to predetermined temperatures, each predetermined temperature corresponding to a predetermined color shift of the thermochromic material; and while heating the individually selected pixels, flooding an area that includes the individually selected pixels with an amount of UV radiation sufficient to at least partially polymerize the thermochromic material, wherein a color of each individually selected pixel is determined by a predetermined temperature to which the pixel is heated and the amount of UV radiation to which the pixel is exposed.

2. The method of claim 1, wherein heating the individually selected pixels comprises:

spatially patterning heat producing energy in a two dimensional image plane; and simultaneously exposing multiple individually selected pixels of the thermochromic material corresponding to the two dimensional image plane to the spatially patterned heat producing energy such that some of the multiple individually selected pixels are heated to a first temperature and others of the multiple individually selected pixels are heated to a different second temperature, the first temperature producing a first color shift of the thermochromic material and the second temperature producing a different second color shift of the thermochromic material.

3. The method of claim 2, further comprising moving the two dimensional image plane while heating the individually selected pixels and flooding the area of the multiple individually selected pixels with UV radiation.

4. The method of claim 1, wherein heating the individually selected pixels comprises heating the individually selectable pixels with laser radiation.

5. The method of claim 4, wherein heating the individually selected pixels with laser radiation comprises heating first pixels of the individually selected pixels with a first laser at a first radiation intensity and heating second pixels of the individually selected pixels with a second laser at a second radiation intensity.

6. The method of claim 4, wherein heating the individually selected pixels with the laser radiation comprises:

spatially patterning the laser radiation to produce a two dimensional image plane of spatially patterned radiation that varies in radiation intensity across the image plane; and simultaneously exposing multiple individually selected pixels of the thermochromic material corresponding to the two dimensional image plane to the spatially patterned radiation.

7. The method of claim 6, wherein spatially patterning the laser radiation comprises spatially patterning the laser radiation produced by one or more lasers to produce the two dimensional image plane.

8. The method of claim 6, wherein spatially patterning the laser radiation to produce the two dimensional image plane comprises:

modulating intensity produced by multiple lasers; and directing the radiation produced by the multiple lasers through multiple optical fibers arranged in a two dimensional array.

9. The method of claim 6, wherein spatially patterning the laser radiation and simultaneously exposing the multiple individually selected pixels comprises simultaneously exposing some of the multiple individually selected pixels to a different amount of radiation when compared to others of the multiple individually selected pixels.

10. The method of claim 1, wherein heating the one or more individually selected pixels comprises one or more of:

heating the one or more individually selected pixels respectively with one or more resistive heating elements; and heating the one or more individually selected pixels respectively with one or more streams of hot gas.

11. An apparatus for forming a multi-colored image on a substrate that includes a thermochromic material capable of producing at least two different colors, the apparatus comprising:

a heat source configured to heat one or more individually selected pixels of the image to one or more predetermined temperatures, each predetermined temperature corresponding to a predetermined color shift of the thermochromic material; and a UV radiation source configured to flood an area that includes the individually selected pixels of the thermochromic material with UV radiation sufficient to at least partially polymerize the thermochromic material during a period of time that the individually selected pixels are being heated by the heat source.

12. The apparatus of claim 11, wherein:

the heat source is configured to produce a two dimensional image plane of spatially modulated heating energy such that multiple individually selected pixels of the thermochromic material corresponding to the two dimensional image plane are simultaneously heated; and the UV radiation source is configured to flood the area of the multiple individually selected pixels with the UV radiation during a period of time that the multiple individually selected pixels are being heated by the heat source.

13. The apparatus of claim 11, wherein the heat source comprises one or more lasers configured to heat the individually selected pixels with laser radiation.

14. The apparatus of claim 11, wherein the heat source comprises at least one of:

one or more resistive heating elements; and one or more of gas jets configured to expel one or more streams of heated gas.

15. The apparatus of claim 11, wherein the heat source comprises:

one or more lasers; and a spatial radiation patterning device, the one or more lasers and the spatial radiation patterning device configured to produce a two dimensional image plane of spatially patterned laser radiation that varies in intensity across the image plane and configured to simultaneously heat multiple individually selected pixels corresponding to the two dimensional image plane.

16. The apparatus of claim 15, further comprising a controller configured to control the lasers and the spatial radiation patterning device to produce the two dimensional image plane of spatially patterned laser radiation.

17. The apparatus of claim 15, wherein:

the one or more lasers comprises a single laser configured to generate the laser radiation; and the spatial radiation patterning device is configured to spatially pattern the laser radiation from the single laser to produce the two dimensional image plane of spatially modulated laser radiation.

18. The apparatus of claim 15, wherein:

the one or more lasers comprises multiple lasers; and the spatial radiation patterning device comprises a two dimensional array of the multiple lasers, the two dimensional array configured to produce the two dimensional image plane of spatially patterned laser radiation.

19. The apparatus of claim 15, wherein:

the one or more lasers comprises multiple lasers; and the spatial patterning device comprises multiple optical fibers, each optical fiber having an input end respectively optically coupled to one of the multiple lasers and an output end, the output ends of the optical fibers arranged in an two dimensional array configured to produce the two dimensional image plane of spatially patterned laser radiation.

20. The apparatus of claim 11, wherein:

the one or more individually selected pixels comprise multiple individually selected pixels of the thermochromic material;

the heat source is configured to produce a two dimensional image plane of spatially patterned heat energy that simultaneously heats the multiple individually selected pixels;

the UV radiation source is directed toward an area that includes the multiple individually selected pixels of the thermochromic material; and further comprising a movement mechanism configured to move the two dimensional image plane and the direction of the UV radiation in synchrony such that two dimensional image plane is flooded with the UV radiation while the multiple individually selected pixels are being heated.

* * * * *